US008720548B2

(12) United States Patent
Banerjee et al.

(10) Patent No.: US 8,720,548 B2
(45) **Date of Patent: *May 13, 2014**

(54) PROCESS FOR ENHANCED PRODUCTION OF HEAVY OIL USING MICROWAVES

(75) Inventors: Dwijen K. Banerjee, Owasso, OK (US); John L. Stalder, Calgary (CA); Tawfik N. Nasr, Katy, TX (US); Wayne Reid Dreher, Jr., College Station, TX (US)

(73) Assignee: ConocoPhillips Company, Houston, TX (US)

( * ) Notice: Subject to any disclaimer, the term of this patent is extended or adjusted under 35 U.S.C. 154(b) by 198 days.

This patent is subject to a terminal disclaimer.

(21) Appl. No.: 13/154,897

(22) Filed: Jun. 7, 2011

(65) Prior Publication Data

US 2011/0253369 A1 Oct. 20, 2011

Related U.S. Application Data

(63) Continuation-in-part of application No. 12/239,051, filed on Sep. 26, 2008, now Pat. No. 7,975,763.

(60) Provisional application No. 61/383,078, filed on Sep. 15, 2010, provisional application No. 61/449,450, filed on Mar. 4, 2011.

(51) Int. Cl.
*E21B 43/24* (2006.01)
*C09K 8/592* (2006.01)

(52) U.S. Cl.
USPC .... 166/248; 166/65.1; 166/272.1; 166/272.3; 166/272.6; 166/302; 507/269

(58) Field of Classification Search
None
See application file for complete search history.

(56) References Cited

U.S. PATENT DOCUMENTS

| | | | |
|---|---|---|---|
| 4,094,798 | A | 6/1978 | Tate et al. |
| RE30,738 | E | 9/1981 | Bridges et al. |
| 4,457,365 | A | 7/1984 | Kasevich et al. |
| 4,485,868 | A | 12/1984 | Sresty et al. |
| 4,620,593 | A | 11/1986 | Haagensen |
| 4,638,863 | A | 1/1987 | Wilson |
| 4,700,716 | A | 10/1987 | Kasevich et al. |
| 4,817,711 | A | 4/1989 | Jeambey |
| 4,912,971 | A | 4/1990 | Jeambey |
| 5,082,054 | A | 1/1992 | Kiamanesh |
| 5,109,927 | A | 5/1992 | Supernaw et al. |
| 5,321,222 | A | 6/1994 | Bible et al. |
| 5,521,360 | A | 5/1996 | Johnson et al. |

(Continued)

FOREIGN PATENT DOCUMENTS

| | | |
|---|---|---|
| GB | 0896407 | 5/1962 |
| JP | 5112004104 | 10/1976 |
| WO | 2007/081493 A2 | 7/2007 |

OTHER PUBLICATIONS

Deutsch, C.V. and McLennan, J.A., Guide to SAGD (Steam Assisted Gravity Drainage) Reservoir Characterization Using Geostatistics, 2005, Centre for Computational Geostatistics. cited by other.

*Primary Examiner* — George Suchfield
(74) *Attorney, Agent, or Firm* — ConocoPhillips Company

(57) ABSTRACT

A process for utilizing microwaves to heat $H_2O$ and sulfur hexafluoride within a subterranean region wherein the heated $H_2O$ and sulfur hexafluoride contacts heavy oil in the subterranean region to lower the viscosity of the heavy oil and improve production of the heavy oil.

19 Claims, 2 Drawing Sheets

(56) References Cited

U.S. PATENT DOCUMENTS

| | | | | |
|---|---|---|---|---|
| 5,899,274 | A | 5/1999 | Frauenfeld et al. | |
| 6,012,520 | A | 1/2000 | Yu et al. | |
| 6,544,411 | B2 | 4/2003 | Varadaraj | |
| 6,814,141 | B2 | 11/2004 | Huh et al. | |
| 7,073,577 | B2 | 7/2006 | Yu | |
| 7,091,460 | B2 | 8/2006 | Kinzer | |
| 7,461,693 | B2 | 12/2008 | Considine et al. | |
| 7,484,561 | B2 | 2/2009 | Bridges | |
| 7,677,673 | B2 | 3/2010 | Tranquilla et al. | |
| 7,975,763 | B2 * | 7/2011 | Banerjee et al. | 166/248 |
| 2005/0199386 | A1 | 9/2005 | Kinzer | |
| 2007/0131591 | A1 | 6/2007 | Pringle | |
| 2007/0289736 | A1 | 12/2007 | Kearl et al. | |
| 2008/0073079 | A1 | 3/2008 | Tranquilla et al. | |
| 2009/0071648 | A1 | 3/2009 | Hagen et al. | |
| 2009/0139716 | A1 | 6/2009 | Brock et al. | |
| 2011/0120709 | A1 * | 5/2011 | Nasr et al. | 166/272.3 |
| 2012/0085537 | A1 * | 4/2012 | Banerjee et al. | 166/272.3 |

* cited by examiner

PROCESS FOR ENHANCED PRODUCTION OF HEAVY OIL USING MICROWAVES

CROSS-REFERENCE TO RELATED APPLICATIONS

This application is a continuation-in-part application which claims benefit under 35 USC §120 to U.S. application Ser. No. 12/239,051 filed Sep. 26, 2008 entitled "PROCESS FOR ENHANCED PRODUCING OF HEAVY OIL USING MICROWAVES," incorporated herein in their entirety and a non-provisional application which claims benefit under 35 USC §119(e) to U.S. Provisional Application Ser. No. 61/383,078 filed Sep. 15, 2010 entitled "HEAVY OIL RECOVERY PROCESS USING CARBONLESS SOLVENT ASSISTED BY RADIO FREQUENCY (RF) HEATING" and U.S. Provisional Application Ser. No. 61/449,450 filed Mar. 4, 2011 entitled "HEAVY OIL RECOVERY PROCESS USING CARBONLESS SOLVENT ASSISTED BY RADIO FREQUENCY HEATING" which is incorporated herein in its entirety.

STATEMENT REGARDING FEDERALLY SPONSORED RESEARCH OR DEVELOPMENT

None.

FIELD OF THE INVENTION

The present invention relates generally to a process for recovering heavy oil from a reservoir.

BACKGROUND OF THE INVENTION

Heavy oil is naturally formed oil with very high viscosity but often contains impurities such as sulfur. While conventional light oil has viscosities ranging from about 0.5 centipoise (cP) to about 100 cP, heavy oil has a viscosity that ranges from 100 cP to over 1,000,000 cP. Heavy oil reserves are estimated to equal about fifteen percent of the total remaining oil resources in the world. In the United States alone, heavy oil resources are estimated at about 30.5 billion barrels and heavy oil production accounts for a substantial portion of domestic oil production. For example, in California alone, heavy oil production accounts for over sixty percent of the states total oil production. With reserves of conventional light oil becoming more difficult to find, improved methods of heavy oil extractions have become more important. Unfortunately, heavy oil is typically expensive to extract and recovery is much slower and less complete than for lighter oil reserves. Therefore, there is a compelling need to develop a more efficient and effective means for extracting heavy oil.

Viscous oil that is too deep to be mined from the surface may be heated with hot fluids or steam to reduce the viscosity sufficiently for recovery by production wells. A variety of processes are used to recover viscous hydrocarbons, such as heavy crude oils and bitumen, from underground deposits. There are extensive deposits of viscous hydrocarbons throughout the globe, including large deposits in the Northern Alberta tar sands that are not recoverable with traditional oil well production technologies. A problem associated with producing hydrocarbons from such deposits is that the hydrocarbons are too viscous to flow at commercially viable rates at the temperatures and pressures present in the reservoir. In some cases, these deposits are mined using open-pit mining techniques to extract the hydrocarbon-bearing material for later processing to extract the hydrocarbons.

Alternatively, thermal techniques may be used to heat the reservoir fluids and rock to produce the heated, mobilized hydrocarbons from wells. One such technique for utilizing a single well for injecting heated fluids and producing hydrocarbons is described in U.S. Pat. No. 4,116,275, which also describes some of the problems associated with the production of mobilized viscous hydrocarbons from horizontal wells.

One thermal method of recovering viscous hydrocarbons using two vertically spaced wells is known as steam-assisted gravity drainage (SAGD) process. The SAGD process is currently the only commercial process that allows for the extraction of bitumen at depths too deep to be strip-mined. Various embodiments of the SAGD process are described in Canadian Patent No. 1,304,287 and corresponding U.S. Pat. No. 4,344,485. In the SAGD process, steam is pumped through an upper, horizontal injection well into a viscous hydrocarbon reservoir while the heated, mobilized hydrocarbons are produced from a lower, parallel, horizontal production well vertically spaced proximate to the injection well. The injection and production wells are typically located close to the bottom of the hydrocarbon deposits.

The SAGD process is believed to work as follows. The injected steam creates a "steam chamber" in the reservoir around and above the horizontal injection well. As the steam chamber expands upwardly and laterally from the injection well, viscous hydrocarbons in the reservoir are heated and mobilized, especially at the margins of the steam chamber where the steam condenses and heats a layer of viscous hydrocarbons by thermal conduction. The heated, mobilized hydrocarbons (and steam condensate) drain under the effects of gravity towards the bottom of the steam chamber, where the production well is located. The mobilized hydrocarbons are collected and produced from the production well. The rate of steam injection and the rate of hydrocarbon production may be modulated to control the growth of the steam chamber to ensure that the production well remains located at the bottom of the steam chamber and in a position to collect the mobilized hydrocarbons.

In order to initiate a SAGD production, thermal communication must be established between an injection and a production SAGD well pair. Initially, the steam injected into the injection well of the SAGD well pair will not have any effect on the production well until at least some thermal communication is established because the hydrocarbon deposits are so viscous and have little mobility. Accordingly, a start-up phase is required for the SAGD operation. Typically, the start-up phase takes about three months before thermal communication is established between the SAGD well pair, depending on the formation lithology and the actual inter-well spacing.

The traditional approach to starting-up the SAGD process is to simultaneously operate the injection and production wells independently of one another to circulate steam. The injection and production wells are each completed with a screened (porous) casing (or liner) and an internal tubing string extending to the end of the liner, forming an annulus between the tubing string and casing. High pressure steam is simultaneously injected through the tubing string of both the injection and production wells. Fluid is simultaneously produced from each of the injection and production wells through the annulus between the tubing string and the casing. In effect, heated fluid is independently circulated in each of the injection and production wells during the start-up phase, heating the hydrocarbon formation around each well by thermal conduction. Independent circulation of the wells is continued until efficient thermal communication between the wells is established. In this way, an increase in the fluid transmissibility through the inter-well span between the injection and production wells is established by conductive heating. The pre-heating stage typically takes about three to four months. Once sufficient thermal communication is established between the injection wells, the upper, injection well is dedicated to steam injection and the lower production well is dedicated to fluid production.

There are several patents on the improvements to SAGD operation. U.S. Pat. No. 6,814,141 describes applying vibrational energy in a well fracture to improve SAGD operation. U.S. Pat. No. 5,899,274 teaches addition of solvents to improve oil recovery. U.S. Pat. No. 6,544,411 describes decreasing the viscosity of crude oil using ultrasonic source. U.S. Pat. No. 7,091,460 claims in situ, dielectric heating using variable radio frequency waves.

In a recent patent publication (U.S. Patent Publication 20070289736/US-A1, filed May 25, 2007), it is disclosed to extract hydrocarbons from a target formation, such as a petroleum reservoir, heavy oil, and tar sands by utilizing microwave energy to fracture the containment rock and for liquification or vitalization of the hydrocarbons.

In another recent patent publication (US Patent Publication 20070131591/US-A1, filed Dec. 14, 2006), it is disclosed that lighter hydrocarbons can be produced from heavier carbon-base materials by subjecting the heavier materials to microwave radiations in the range of about 4 GHz to about 18 GHz. This publication also discloses extracting hydrocarbons from a reservoir where a probe capable of generating microwaves is inserted into the oil wells and the microwaves are used to crack the hydrocarbons with the cracked hydrocarbon thus produced being recovered at the surface.

Despite these disclosures, it is unlikely that direct microwave cracking or heating of hydrocarbons would be practical or efficient. It is known that microwave energy is absorbed by a polar molecule with a dipole moment and bypasses the molecules that lack dipole moment. The absorption of the microwave energy by the polar molecule causes excitation of the polar molecule thereby transforming the microwave energy into heat energy (known as the coupling effect). Accordingly, when a molecule with a dipole moment is exposed to microwave energy it gets selectively heated in the presence of non-polar molecules. Generally, heavy oils comprise non-polar hydrocarbon molecules; accordingly, hydrocarbons would not get excited in the presence of microwaves.

Additionally, while the patent publication above claims to break the hydrocarbon molecules, the energy of microwave photons is very low relative to the energy required to cleave a hydrocarbon molecule. Thus, when hydrocarbons are exposed to microwave energy, it will not affect the structure of a hydrocarbon molecule. (See, for example, "Microwave Synthesis", CEM Publication, 2002 by Brittany Hayes).

BRIEF SUMMARY OF THE DISCLOSURE

A process of injecting $H_2O$ and sulfur hexafluoride into a subterranean region through a first wellbore of a steam assisted gravity drainage operation. Microwaves are introduced into the region at a frequency sufficient to excite the $H_2O$ and sulfur hexafluoride molecules and increase the temperature of at least a portion of the $H_2O$ and sulfur hexafluoride within the region to produce heated $H_2O$ and heated sulfur hexafluoride. At least a portion of the heavy oil in the region is heated by contact with the heated $H_2O$ and the heated sulfur hexafluoride to produce heated heavy oil. Heated heavy oil is produced through a second wellbore of the steam assisted gravity drainage operation, thereby recovering heavy oil with the steam assisted gravity drainage operation form the subterranean region. In this embodiment a portion of the $H_2O$ is injected as steam and the steam contact with at least a portion of the heavy oil in the region so as to heat the portion of the heavy oil and reduce its viscosity so that it flows generally towards the second wellbore.

In an alternate embodiment a process is taught of injecting liquid $H_2O$ and sulfur hexafluoride into a region through a first wellbore of a team assisted gravity drainage operation. Microwaves are introduced into the subterranean region at a frequency sufficient to excite the liquid $H_2O$ and sulfur hexafluoride molecules and increase the temperature of at least a portion of the liquid $H_2O$ and sulfur hexafluoride within the region to produce heated gaseous $H_2O$ and heated sulfur hexafluoride. AT least a portion of the heavy oil is heated in the region by contact with the heated gaseous $H_2O$ and heated sulfur hexafluoride to produce heated heavy oil. Heated heavy oil is produced through a second wellbore of the steam assisted gravity drainage operation, thereby recovering heavy oil with the steam assisted gravity drainage operation form the subterranean region. In this embodiment a portion of the $H_2O$ is injected as steam and the steam contact with at least a portion of the heavy oil in the region so as to heat the portion of the heavy oil and reduce its viscosity so that it flows generally towards the second wellbore.

In yet another embodiment a process begins by injecting $H_2O$ and sulfur hexafluoride into a subterranean region through an injection wellbore of a team assisted gravity drainage operation. Microwaves are introduced in the region at a frequency sufficient to excite the $H_2O$ molecules and sulfur hexafluoride molecules and increase the temperature of at least a portion of the $H_2O$ and sulfur hexafluoride within the region to produce heated $H_2O$ and heated sulfur hexafluoride. At least a portion of the bitumen is heated to below 3000 cp in the region by contact with the heated $H_2O$ and heated sulfur hexafluoride to produce a heated heavy oil and an imposed pressure differential between the injection wellbore and a production wellbore. Heated heavy oil is produced through the production wellbore of the steam assisted gravity drainage operation, thereby recovering heavy oil with the steam assisted gravity drainage operation form the subterranean region. In this embodiment a portion of the $H_2O$ is injected as steam and the steam contact with at least a portion of the heavy oil in the region so as to heat the portion of the heavy oil and reduce its viscosity so that it flows generally towards the second wellbore. Furthermore the injection wellbore and the production wellbore are from 3 meters to 7 meters apart and the injection wellbore is located higher than the production wellbore.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

In this description, the term water is used to refer to $H_2O$ in a liquid state and the term steam is used to refer to $H_2O$ in a gaseous state.

Figure 1:
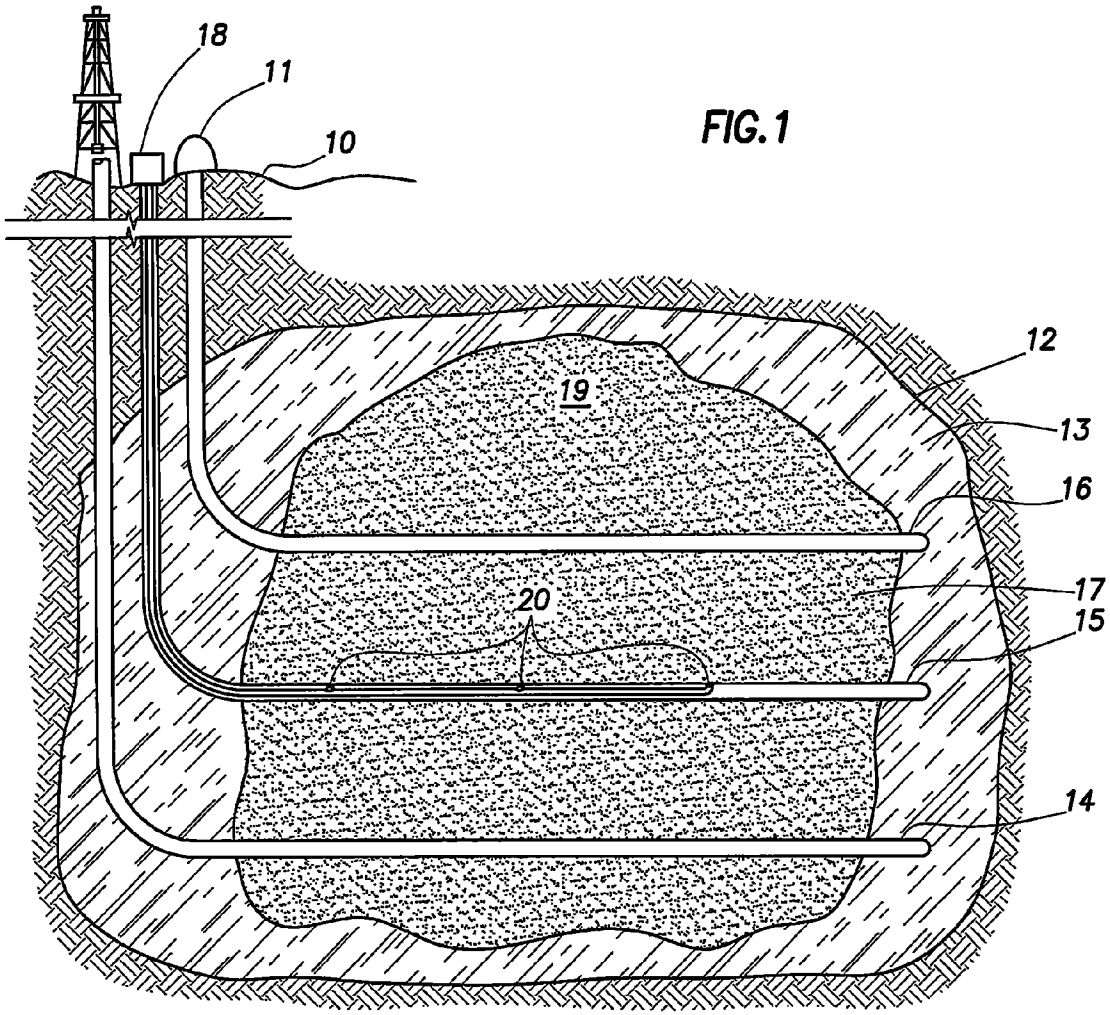
FIG. 1 is a schematic diagram illustrating a heavy oil heating process, wherein wave guides are used to introduce the microwaves to the reservoir.

Turning now to FIG. 1, wellbores 14, 15 and 16 are illustrated. Wellbore 14 extends from the surface 10 into a lower portion of subterranean region 12. Wellbore 16 extends from the surface 10 into subterranean region 12 and generally will be higher than wellbore 14. Wellbore 16 will be used to inject $H_2O$ and sulfur hexafluoride and it is preferred that it is located higher than wellbore 14 so that when the injected $H_2O$ and heated sulfur hexafluoride heats the heavy oil, the heavy oil will flow generally towards wellbore 14, which is used to extract the heavy oil from the reservoir. In one embodiment a portion of the $H_2O$ is injected as steam and the steam contacts with at least a portion of the heavy oil in the region so as to heat the portion of the heavy oil and reduce its viscosity so that it flows generally towards the second wellbore. Wellbore 15 is used to introduce microwaves to the reservoir and it is preferred that wellbore 15 be located intermittent to wellbores 14 and 15; although, other arrangements are possible.

This method can also be used with a variety of enhanced oil recovery systems. Examples of enhanced oil recovery systems include: steam assisted gravity drainage, steam drive, cyclic steam stimulation or combinations thereof.

In one embodiment the sulfur hexafluoride can be injected into the region in either liquid, gas, or even subcritical or supercritical fluid. Since sulfur hexafluoride is at least one hundred times more soluble in hydrocarbons when compared to water it is able to reduce the amount of water injected region over conventional steam assisted gravity drainage operations. In one embodiment the method can reduce the amount of water used by 5%, 10%, 20%, 30%, 40%, 50%, 60%, 70%, 80% even 90% of what is typically used during conventional steam assisted gravity drainage operations.

In another embodiment the method is capable of operating at temperatures much less than conventional steam assisted gravity drainage operations. In one embodiment the hydrocarbon region only needs to be heated to a temperature of 200° C. before sufficient heat transfer has occurred to the hydrocarbon fluid to promote the flow of the heavy oil.

In operation, steam generated in boiler 11 is provided into the reservoir 12 through upper wellbore leg 16. The steam and heated sulfur hexafluoride heats the heavy oil within zone 17 of the oil-bearing portion 13 of reservoir 12 causing it to become less viscous and, hence, increase its mobility. The heated heavy oil flows downward by gravity and is produced through wellbore leg 14. While FIG. 1 illustrates a single wellbore for injection and a single wellbore for extraction, other configurations are within the scope of the invention, for example, there can be two or more separate wellbores to provide steam injection and two or more separate wellbores for production. Similarly, multiple wellbores can be used for microwave introduction to the reservoir, as further discussed below.

Generally, the wellbore for steam and sulfur hexafluoride injection, wellbore 16, will be substantially parallel to and situated above the wellbore for production, wellbore 14, which is located horizontally near the bottom of the formation. Pairs of steam and sulfur hexafluoride injection wellbores and production wellbores will generally be close together and located at a suitable distance to create an effective steam chamber and yet minimizing the preheating time. Typically, the pairs of injection and production wellbores will be from about 3 meters to 7 meters apart and preferably there will be about 5 meters of vertical separation between the injector and producer wellbores. In other embodiments it is possible for the injection and production wellbores be anywhere from 1, 3, 5, 7, 12, 15, 20 even 25 meters of horizontal separation apart. Additionally, in other embodiments it is possible for the injection and production wellbores be anywhere from 1, 3, 5, 7, 12, 15, 20 even 25 meters of vertical separation apart. In this type of SAGD operation, the zone 17 is preheated by steam circulation until the reservoir temperature between the injector and producer wellbore is at a temperature sufficient to drop the viscosity of the heavy oil so that it has sufficient mobility to flow to and be extracted through wellbore 14. Generally, the heavy oil will need to be heated sufficiently to reduce its viscosity to below 3000 cP; however, lower viscosities are better for oil extraction and, thus, it is preferable that the viscosity be below 1500 cP and more preferably below 1000 cP. Preheating zone 17 involves circulating steam inside a liner using a tubing string to the toe of the wellbore. Both the injector and producer would be so equipped. Steam circulation through wellbores 14 and 16 will occur over a period of time, typically about 3 months. During the steam circulation, heat is conducted through the liner wall into the reservoir near the liner. At some point before the circulation period ends, the temperature midway between the injector and producer will reach a temperature wherein the bitumen will become movable typically around 3000 cP or less or from about 80 to 100° C. Once this occurs, the steam circulation rate for wellbore 14 will be gradually reduced while the steam rate for the injector wellbore 16 will be maintained or increased. This imposes a pressure gradient from high, for the area around wellbore 16, to low, for the area around wellbore 14. With the oil viscosity low enough to move and the imposed pressure differential between the injection and production wellbores, steam (usually condensed to hot water) starts to flow from the injector into the producer. As the steam rate is continued to be adjusted downward in wellbore 14 and upward in wellbore 16, the system arrives at steam assisted gravity drainage operation with no steam injection through wellbore 14 and all the steam injection through wellbore 16. Once hydraulic communication is established between the pair of injector and producer wellbores, steam injection in the upper well and liquid production from the lower well can proceed. Due to gravity effects, the steam vapor tends to rise and develop a steam chamber at the top section 19 of zone 17. The process is operated so that the liquid/vapor interface is maintained between the injector and producer wellbores to form a steam trap which prevents live steam from being produced through the lower wellbore.

During operation, steam will come into contact with the heavy oil in zone 17 and, thus, heat the heavy oil and increase its mobility by lessening its viscosity. Heated heavy oil will tend to flow downward by gravity and collect around wellbore 14. Heated heavy oil is produced through wellbore 14 as it collects. Steam contacting the heavy oil will lose heat and tend to condense into water. The water will also tend to flow downward toward wellbore 14. In past SAGD operations, this water would also be produced through wellbore 14. Such produced water would need to be treated to reduce impurities before being reheated in the boiler for subsequent injection. As the process continues operation, zone 17 will expand with heavy oil production occurring from a larger portion of oil-bearing portion 13 of subterranean formation 12.

Turning again to FIG. 1, the current invention provides for microwave generator 18 to generate microwaves which are directed underground and into zone 17 of the reservoir through a series of wave guides 20. The diameter of the wave guides will preferably be more than 3 inches in order to ensure good transmission of the microwaves. Within the reservoir, the microwaves will be at a frequency substantially equivalent to the resonant frequency of the water or sulfur hexafluoride within the reservoir so that the microwaves excite the water molecules and/or sulfur hexafluoride molecules causing them to heat up. Optimally, the microwaves will be introduced at or near the liquid vapor interface so that condensed steam is reheated from its water state back into steam further supplying the steam chamber. In some embodiments the microwave frequency will be not greater than 3000 megahertz and/or at a resonant frequency of water. Based on the resonant frequency of water, the optimum frequency will be 2450 megahertz; however, power requirements and other factors may dictate that another frequency is more economical. Additionally, salt and other impurities may enhance the coupling effect (production of heat by resonance of a polar or conductive molecule with microwave energy); thus, the presence of salt is desirable.

Figure 2:
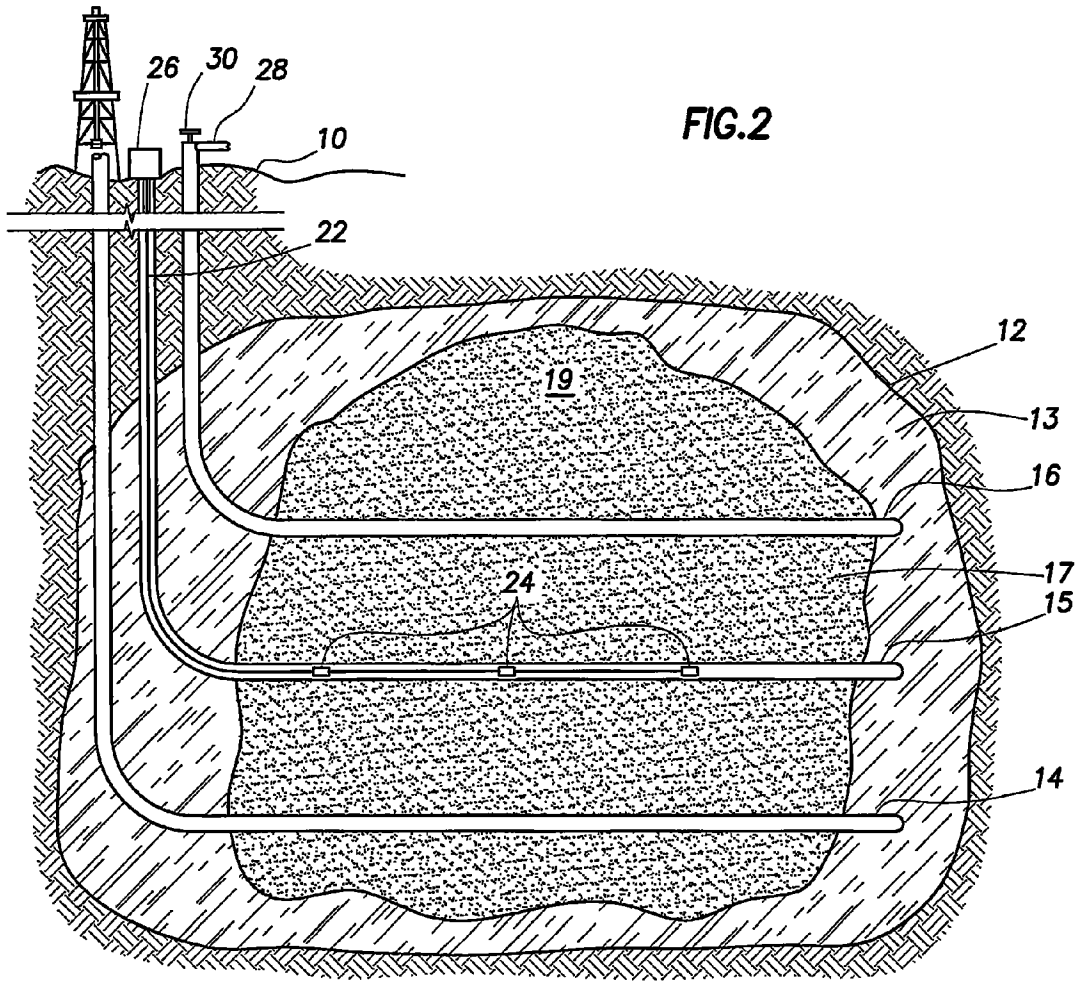
FIG. 2 is a schematic diagram illustrating a heavy oil heating process wherein the microwaves are introduced into the reservoir using a microwave generator located within the reservoir.

Turning now to FIG. 2, a further embodiment of the invention is illustrated wherein, instead of using wave guides, power is supplied through electrical wire 22 to microwave generating probe 24. The electrical power can be supplied to wire 22 by any standard means such as generator 26.

In still another embodiment of the invention, also illustrated in FIG. 2, no steam boiler is used. Instead water and sulfur hexafluoride is introduced directly into wellbore 16 through pipe 28 and valve 30. Wellbore 16 then introduces water and sulfur hexafluoride into the reservoir instead of steam and the entire steam production would be accomplished through use of the microwave generators. This embodiment of the invention has the added advantage of avoiding costly water treatment that is necessary when using a boiler to generate steam because, as discussed above, salt and other impurities can aid in heat generation. In a preferred embodiment, the water introduced into the reservoir would have a salt content greater than the natural salt content of the reservoir, which is typically about 5,000 to 7,000 ppm. Accordingly, it is preferred that the introduced water has a salt content greater than 10,000 ppm. For enhanced heat generation 30,000 to 50,000 ppm is more preferred.

Microwave generators useful in the invention would be ones suitable for generating microwaves in the desired frequency ranges recited above. Microwave generators and wave guide systems adaptable to the invention are sold by Cober Muegge LLC, Richardson Electronics and CPI International Inc.

Steam to oil ratio is an important factor in SAGD operations and typically the amount of water required will be 2 to 3 times the oil production. Higher steam to oil production ratios require higher water and natural gas costs. The present invention reduces water and natural gas requirements and reduces some of the water handling involving recycling, cooling, and cleaning up the water.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process comprising:

(a) injecting $H_2O$ and sulfur hexafluoride into a subterranean region through a first wellbore of a steam assisted gravity drainage operation;

(b) introducing microwaves into the region at a frequency sufficient to excite the $H_2O$ and sulfur hexafluoride molecules and increase the temperature of at least a portion of the $H_2O$ and sulfur hexafluoride within the region to produce heated $H_2O$ and heated sulfur hexafluoride (c) heating at least a portion of the heavy oil in the region by contact with the heated $H_2O$ and heated sulfur hexafluoride to produce heated heavy oil; and (d) producing the heated heavy oil through a second wellbore of the steam assisted gravity drainage operation;

thereby recovering heavy oil with the steam assisted gravity drainage operation from the subterranean region;

wherein a portion of the $H_2O$ is injected as steam and the steam contacts with at least a portion of the heavy oil in the region so as to heat the portion of the heavy oil and reduce its viscosity so that it flows generally towards the second wellbore.

2. The process of claim 1 wherein at least a portion of the steam condenses to a liquid state to form water as a result of its contact with the heavy oil and wherein the microwaves excite the molecules of at least a portion of the water so that the water is heated and becomes steam.

3. The process of claim 2 wherein the microwaves are generated at the surface and introduced into the region through at least one waveguide.

4. The process of claim 3, wherein the microwaves have a frequency which is less than or equal to 3000 MHz.

5. The process of claim 4 wherein the microwaves are generated within the region.

6. The process of claim 5 wherein the microwaves have a frequency which is less than or equal to 3000 MHz.

7. The process of claim 1 further comprising injecting at least a portion of the $H_2O$ as water and wherein the microwaves excite the molecules of at least a portion of the thus injected water so that the water is heated and becomes steam.

8. The process of claim 7 wherein the thus injected water has a salt content of at least 10,000 ppm.

9. The process of claim 7 wherein the steam contacts at least a portion of the heavy oil in the region so as to heat the heavy oil and reduce its viscosity so that it flows generally towards the second wellbore.

10. The process of claim 7 wherein at least a portion of the steam condenses to a liquid state to form water as a result of its contact with the heavy oil and wherein the microwaves excite the molecules of at least a portion of the thus formed water so that the water is heated and becomes steam.

11. The process of claim 10 further comprising injecting at least a portion of the $H_2O$ as water in step (a).

12. The process of claim 11 wherein the thus injected water has a salt content of at least 10,000 ppm.

13. The process of claim 11 wherein the microwaves are generated at the surface and introduced into the region through at least one waveguide.

14. The process of claim 13, wherein the microwaves have a frequency which is less than or equal to 3000 MHz.

15. The process of claim 11 wherein the microwaves are generated within the region.

16. The process of claim 15 wherein the microwaves have a frequency which is less than or equal to 3000 MHz.

17. The process of claim 1, wherein the amount of injected $H_2O$ is about 50% less than producing the heavy oil with steam assisted gravity drainage techniques without introducing microwaves into the region at a frequency sufficient to excite the $H_2O$ and sulfur hexafluoride molecules.

18. A process comprising:

(a) injecting liquid $H_2O$ and sulfur hexafluoride into a subterranean region through a first wellbore of a steam assisted gravity drainage operation;

(b) introducing microwaves into the subterranean region at a frequency sufficient to excite the liquid $H_2O$ and sulfur hexafluoride molecules and increase the temperature of at least a portion of the liquid $H_2O$ and sulfur hexafluoride within the region to produce heated gaseous $H_2O$ and heated sulfur hexafluoride (c) heating at least a portion of the heavy oil in the region by contact with the heated gaseous $H_2O$ and heated sulfur hexafluoride to produce heated heavy oil; and (d) producing the heated heavy oil through a second wellbore of the steam assisted gravity drainage operation;

thereby recovering heavy oil with the steam assisted gravity drainage operation from a the subterranean region;

wherein a portion of the liquid $H_2O$ is injected as steam and the steam contacts with at least a portion of the heavy oil in the region so as to heat the portion of the heavy oil and reduce its viscosity so that it flows generally towards the second wellbore.

19. A process comprising:

(a) injecting $H_2O$ and sulfur hexafluoride into a subterranean region through an injection wellbore of a steam assisted gravity drainage operation;

(b) introducing microwaves into the region at a frequency sufficient to excite the $H_2O$ molecules and sulfur hexafluoride molecules and increase the temperature of at least a portion of the $H_2O$ and sulfur hexafluoride within the region to produce heated $H_2O$ and heated sulfur hexafluoride;

(c) heating at least a portion of the bitumen to below 3000 cp in the region by contact with the heated $H_2O$ and heated sulfur hexafluoride to produce a heated heavy oil and a imposed pressure differential between the injection wellbore and a production wellbore; and (d) producing the heated heavy oil through the production wellbore of the steam assisted gravity drainage operation;

thereby recovering heavy oil with the steam assisted gravity drainage operation from a the subterranean region wherein the injection wellbore and the production wellbore are from 3 meters to 7 meters apart and the injection wellbore is located higher than the production wellbore;

wherein the $H_2O$ is injected as steam and the steam contacts with at least a portion of the heavy oil in the region so as to heat the portion of the heavy oil and reduce its viscosity so that it flows generally towards the second wellbore.

* * * * *